US012162570B2

(12) United States Patent
Oshima

(10) Patent No.: US 12,162,570 B2
(45) Date of Patent: Dec. 10, 2024

(54) DISPLAY DEVICE FOR WATERCRAFT

(71) Applicant: HONDA MOTOR CO., LTD., Tokyo (JP)

(72) Inventor: Mio Oshima, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 84 days.

(21) Appl. No.: 18/192,666

(22) Filed: Mar. 30, 2023

(65) Prior Publication Data

US 2024/0326961 A1 Oct. 3, 2024

(51) Int. Cl.
*B63B 49/00* (2006.01)

(52) U.S. Cl.
CPC ..... *B63B 49/00* (2013.01)

(58) Field of Classification Search
CPC ..... B63B 49/00; B63B 79/15; B63B 79/40; B63H 21/17; B60L 50/16; B60L 58/18; G01D 7/02; G01D 7/002
See application file for complete search history.

(56) References Cited

U.S. PATENT DOCUMENTS 5,063,381 A * 11/1991 Ito ..... B63B 49/00 340/984
6,273,771 B1 * 8/2001 Buckley ..... G08G 3/02 114/144 RE
7,143,363 B1 * 11/2006 Gaynor ..... B63J 99/00 701/487
7,441,189 B2 * 10/2008 Michaels ..... G06F 3/0482 715/700
7,444,213 B2 * 10/2008 Motose ..... G01D 7/002 701/21
8,229,608 B2 * 7/2012 Yamamura ..... B63H 21/213 701/21
8,290,636 B2 * 10/2012 Manning ..... A63C 17/12 701/1
8,306,673 B1 * 11/2012 Manning ..... A63C 17/12 701/1
D675,637 S * 2/2013 Willard ..... D14/486
8,612,072 B2 * 12/2013 Garon ..... B63H 21/22 340/9.1
8,836,544 B1 * 9/2014 Balogh ..... B63H 21/17 340/459
9,423,614 B2 * 8/2016 Takasu ..... G02B 27/0101
D955,416 S * 6/2022 Prasad ..... D14/486
11,875,030 B1 * 1/2024 King ..... G01S 7/6281
D1,037,283 S * 7/2024 Prasad ..... D14/485
(Continued)

FOREIGN PATENT DOCUMENTS

JP 2006008003 A 1/2006
JP 2011218889 A * 11/2011

*Primary Examiner* — Hoi C Lau
(74) *Attorney, Agent, or Firm* — CKC & Partners Co., LLC

(57) ABSTRACT

Provided is a display device for a watercraft with which a disparity between an operation instruction and an actual speed of the watercraft can be grasped easily. The display device for a watercraft is provided with a first indicator 131 that shows a specified speed based on an operation by a user and a second indicator 132 that shows an actual speed of the watercraft. The first indicator 131 and the second indicator 132 each include a forward indicator 131F, 132F and a reverse indicator 131R, 132R, and the first indicator 131 and the second indicator 132 are displayed in juxtaposition.

10 Claims, 11 Drawing Sheets

(56) References Cited

U.S. PATENT DOCUMENTS

| | | | | |
|---|---|---|---|---|
| 2005/0221953 | A1* | 10/2005 | Okabe | F16H 61/0213 477/120 |
| 2005/0288833 | A1* | 12/2005 | Motose | G01D 7/02 701/431 |
| 2006/0035691 | A1* | 2/2006 | Nystrom | B60K 35/00 463/6 |
| 2006/0185457 | A1* | 8/2006 | Yoshikawa | F16H 59/08 74/335 |
| 2007/0022636 | A1* | 2/2007 | Wakitani | E01H 5/04 37/245 |
| 2015/0015964 | A1* | 1/2015 | Takasu | G02B 27/0101 359/630 |
| 2016/0178413 | A1* | 6/2016 | Yamada | H02P 8/04 116/297 |
| 2020/0329216 | A1* | 10/2020 | Ribighini | B60R 1/28 |
| 2024/0143151 | A1* | 5/2024 | Bennett | G06F 3/0481 |

* cited by examiner

DISPLAY DEVICE FOR WATERCRAFT

BACKGROUND OF THE INVENTION

Field of the Invention

The present disclosure relates to a display device for a watercraft.

Related Art

In a case of a watercraft, when a pilot performs an operation, there is a delay before the watercraft actually moves in response to the content of the operation by the pilot. For example, if a reverse operation is performed while the watercraft is moving forward, the watercraft cannot move in reverse instantaneously, and instead the watercraft gradually slows down and stops before beginning to move in reverse. If there is a large disturbance, such as waves or wind, in the direction opposite to the desired direction of movement, the vessel may be swept away from the desired direction of movement, this situation being especially likely to occur during low-speed operation in which thrust is low. Consequently, there may be a disagreement between the maneuvering direction specified by the pilot and the actual direction of movement of the watercraft, and in some cases, this disagreement may create a feeling of discomfort or confusion in the pilot. In particular, when there is a quay or other stationary land-based object near the watercraft, it is easy for the pilot to sense the actual direction of movement. In contrast, when there is no stationary land-based object near the watercraft, it is difficult for the pilot to sense the direction of movement of the watercraft. Consequently, in such situations, the pilot may be unable to correctly determine the actual direction of movement of the watercraft, which is likely to create a feeling of discomfort in the pilot.

Moreover, even in a case where the maneuvering direction specified by the pilot and the actual direction of movement of the watercraft are in agreement, the pilot may still feel discomfort if the amount of input to the prime mover (the rotation speed of the prime mover) as inputted by the pilot and the vessel speed are largely divergent from each other. For example, if the rotation speed of the prime mover is increased suddenly from a state of low vessel speed, the vessel speed does not immediately reach a high speed even though the rotation speed of the prime mover is high, and the pilot may feel discomfort. This makes it difficult for the pilot to correctly judge whether the vessel speed has reached the specified speed as inputted or the vessel is still accelerating.

A watercraft including an outboard motor has limited space for use for displaying information related to the piloting of the vessel, and therefore, there is a limit on a quantity of information that can be displayed at the same time. Furthermore, it is desirable that necessary information can be checked easily. Japanese Unexamined Patent Application, Publication No. 2006-8003 discloses a configuration in which a display form is switched in response to a button operation, and a navigation information display meter is switched between a mode for displaying the engine rotation speed of an outboard engine and mode for displaying the vessel speed.

Patent Document 1: Japanese Unexamined Patent Application, Publication No. 2006-8003

SUMMARY OF THE INVENTION

However, the display form in Japanese Unexamined Patent Application, Publication No. 2006-8003 does not allow for the engine rotation speed and the vessel speed to be checked at the same time. Consequently, for example, if the vessel speed is going in reverse (a negative display or the like) even though the pilot is performing an operation for moving forward, the pilot may feel even greater discomfort. In addition, displaying the engine rotation speed alone does not enable the pilot to judge whether an appropriate vessel speed corresponding to the engine rotation speed is achieved.

An object of the present disclosure is to provide a display device for a watercraft with which the disparity between an operating instruction and the actual speed of a watercraft can be grasped easily.

The present disclosure is to achieve the above object through solutions described below. Note that although the following description contains reference signs corresponding to an embodiment of the present disclosure to facilitate understanding, the present disclosure is not limited thereto.

According to the first aspect of the disclosure, a display device (111, 130) for a watercraft (200) includes a first indicator (131) that shows a specified speed based on an operation by a user and a second indicator (132) that shows an actual speed of the watercraft. The first indicator (131) and the second indicator (132) each include a forward indicator (131F, 132F) and a reverse indicator (131R, 132R), and the first indicator (131) and the second indicator (132) are displayed in juxtaposition.

According to the second aspect of the disclosure, in the display device (111, 130) for a watercraft (200) as described in the first aspect, the first indicator (131) and the second indicator (132) are each in a circular or partially circular display form and are displayed substantially concentrically.

According to the third aspect of the disclosure, in the display device (111, 130) for a watercraft (200) as described in the first aspect, the first indicator (131) and the second indicator (132) are each in a linear display form and are displayed in juxtaposition.

According to the fourth aspect of the disclosure, in the display device (111, 130) for a watercraft (200) as described in any one of the first to third aspects, the first indicator (131) shows only a specified speed (131L) that takes account of a load factor.

According to the fifth aspect of the disclosure, in the display device (111, 130) for a watercraft (200) as described in any one of the first to third aspects, the first indicator (131) shows both of a specified speed (131P) in an ideal state not taking account of a load factor and a specified speed (131L) taking account of the load factor.

According to the sixth aspect of the disclosure, in the display device (111, 130) for a watercraft (200) as described in any one of the first to third aspects, the first indicator (131) shows only a specified speed (131P) in an ideal state not taking account of a load factor.

According to the seventh aspect of the disclosure, in the display device (111, 130) for a watercraft (200) as described in any one of the first to sixth aspects, the first indicator (131) shows a specified speed (131P) in an ideal state not taking account of a load factor, together with a display of a range of variation (131V) that varies depending on the load factor.

According to the eighth aspect of the disclosure, in the display device (111, 130) for a watercraft (200) as described in the seventh aspect, the display of the range of variation (131V) changes depending on a speed of the watercraft.

According to the ninth aspect of the disclosure, in the display device (111, 130) for a watercraft (200) as described in any one of the first to eighth aspects further includes a third indicator (133) that shows a rotation speed of a prime mover (104) or a screw propeller (105) based on a throttle operation, wherein the first indicator (131) and the third indicator (133) are displayed in juxtaposition.

According to the tenth aspect of the disclosure, in the display device (111, 130) for a watercraft (200) as described in any one of the first to ninth aspects, at least one selected from the first indicator (131) and the second indicator (132) is capable of displaying, on an enlarged scale, a vicinity of a boundary between the forward indicator (131F, 132F) and the reverse indicator (131R, 132R).

The present disclosure provides a display device for a watercraft with which the disparity between an operating instruction and the actual speed of the watercraft can be grasped easily.

DETAILED DESCRIPTION OF THE INVENTION

First Embodiment

Figure 1:
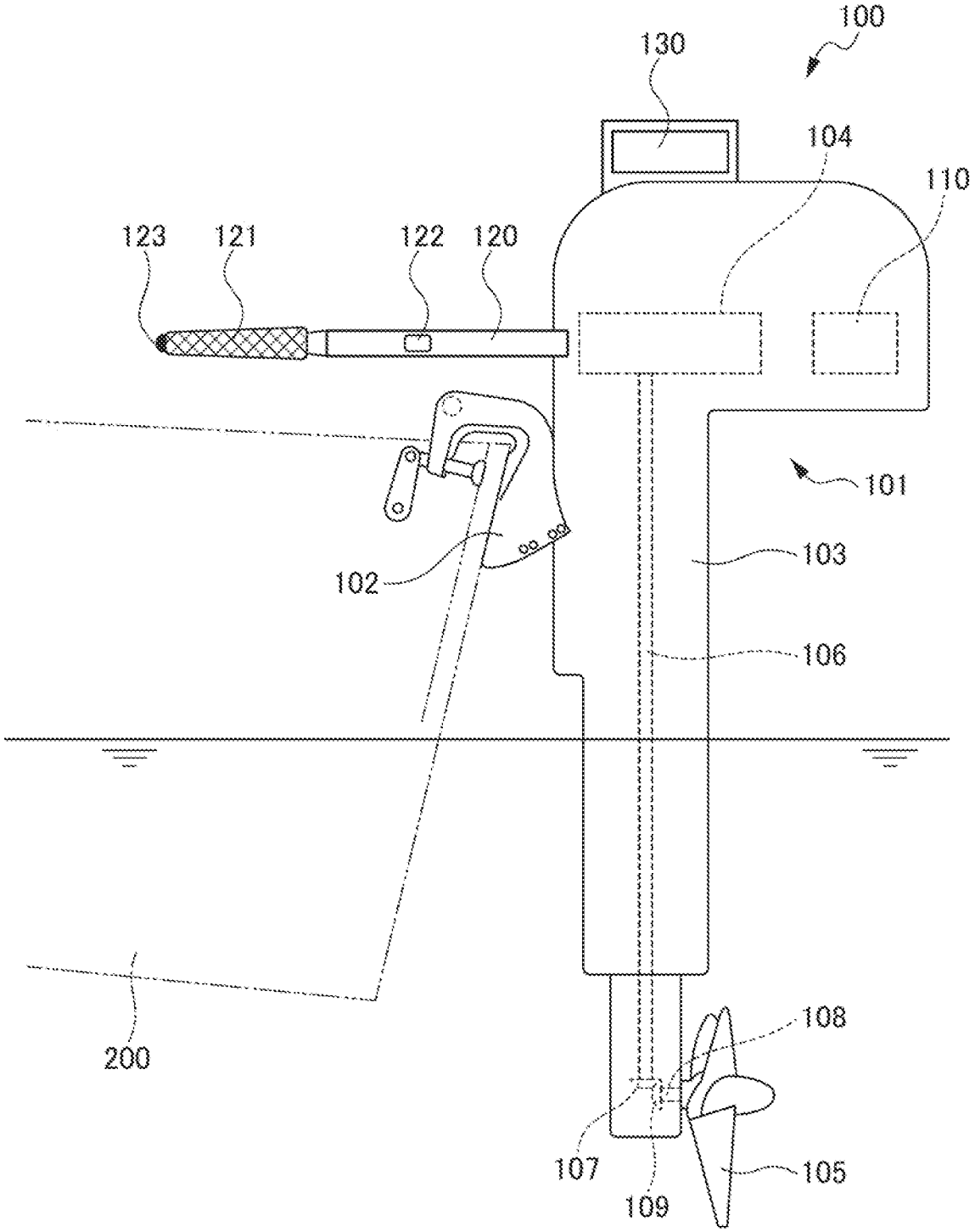
FIG. 1 is a diagram illustrating a first embodiment of an outboard motor 100 provided with a display device according to the present disclosure.

Hereinafter, embodiments for carrying out the present disclosure will be described with reference to the drawings. FIG. 1 is a diagram illustrating a first embodiment of an outboard motor 100 provided with a display device according to the present disclosure. Note that the drawings indicated hereinafter, including FIG. 1, are schematic illustrations in which each part is illustrated with the size and shape exaggerated or abbreviated, as appropriate, to facilitate understanding. Furthermore, the following description indicates specific numerical values, shapes, materials, and the like, but these can be changed as appropriate. In the following description, directional terms such as fore, aft, up, and down are used in reference to a usage scenario in which the outboard motor 100 is mounted onto a hull 200. Note that "fore" denotes the direction in which the vessel moves forward, while "aft" denotes the direction opposite to the "fore". Also, in the following description of the embodiments, a mode in which the outboard motor 100 is mounted onto the hull 200 is given as an example, but the display device of the present disclosure is not limited to the case of using an outboard motor and is also usable in watercrafts employing a sterndrive, an inboard motor, a pod drive, or the like.

The outboard motor 100 is used by being mounted onto a hull 200. The outboard motor 100 is provided with an outboard motor body 101 and a mounting device 102 for mounting the outboard motor body 101 onto the hull 200. The outboard motor body 101 includes a body case 103, a prime mover 104, a screw propeller 105, and a controller 110. Note that although the present embodiment illustrates a mode in which the screw propeller 105 is used to obtain thrust, an outboard motor that uses a water jet to obtain thrust, for example, is also possible. Furthermore, the outboard motor body 101 includes a drive shaft 106, a propeller shaft 108, a tiller handle 120, and a display 130.

The body case 103 is formed from a metallic or plastic material and covers the internal structure of the outboard motor body 101. The upper portion of the body case 103 accommodates the prime mover 104 and the controller 110. The lower portion of the body case 103 accommodates the drive shaft 106, the propeller shaft 108, and the like.

For the prime mover 104, an electric motor, engine (internal combustion engine (ICE)), or the like for rotating the screw propeller 105 can be used. In the case of using an electric motor as the prime mover 104, a power source including a secondary battery or the like is additionally provided. The prime mover 104 is disposed in the upper portion of the body case 103 such that an output shaft thereof extends vertically downward. Note that in the case in which the prime mover 104 is an ICE, a driving direction switching mechanism is provided to switch the rotation direction of the rotary driving force to be transmitted to the drive shaft 106 between forward rotation and reverse rotation.

The drive shaft 106 extends in the vertical direction below the prime mover 104. The upper end of the drive shaft 106 is connected to the output shaft of the prime mover 104. A drive gear 107 configured as a bevel gear is united with the lower end of the drive shaft 106. The drive shaft 106 is rotatably supported by the body case 103.

The propeller shaft 108 extends in the fore-aft direction (substantially the horizontal direction) below the drive shaft 106. The propeller shaft 108 is rotatably supported by the body case 103. A driven gear 109 configured as a bevel gear to engage the drive gear 107 is united with the fore end of the propeller shaft 108. The propeller shaft 108 extends rearward from the body case 103 through a support hole (not shown) in the body case 103, and is exposed on the outside of the body case 103. The rotation of the drive shaft 106 is transmitted to the propeller shaft 108 through the drive gear 107 and the driven gear 109.

The screw propeller 105 is driven by the prime mover 104 to generate thrust. The screw propeller 105 is mounted on the rear portion of the propeller shaft 108 so as to be united with the propeller shaft 108, and can rotate with the propeller shaft 108. The screw propeller 105 is located farther rearward than the rear end of the body case 103, and is exposed on the outside of the body case 103. Multiple fins project out on the circumference of the screw propeller 105.

The tiller handle 120 extends forward (toward the hull 200) from the outboard motor body 101, and can turn with the outboard motor body 101 relative to the hull 200. The tiller handle 120 is moved left and right by the pilot to steer, which causes the outboard motor body 101 to turn left or right relative to the hull 200. The tiller handle 120 includes an accelerator grip 121 rotatably provided on the fore end of the tiller handle 120, an accelerator position sensor 122 that detects the amount of rotation inputted to the accelerator grip 121 (that is, the accelerator position), and a switch 123. The switch 123 is provided on the tip (fore end) of the tiller handle 120. The switch 123 may also be provided on the side of the tiller handle 120 near the tip.

The accelerator grip 121 is normally urged by an urging member to be positioned at an initial position. The accelerator grip 121 accepts an operation of rotating to one side from the initial position and back to the other side toward the initial position as a change operation for changing the output of the prime mover 104. The accelerator position sensor 122 detects the accelerator position of the accelerator grip 121 and outputs a detection signal.

The switch 123 is configured to accept a switching operation for switching the rotation direction of the drive shaft 106 driven by the prime mover 104, and to be selectively switchable between a forward specification that causes the drive shaft 106 to rotate in a direction causing the hull 200 to move forward and a reverse specification that causes the drive shaft 106 to rotate in a direction causing the hull 200 to move in reverse. In the case in which the prime mover 104 is an electric motor, the forward specification and the reverse specification switch the rotation direction of the prime mover 104. On the other hand, in the case in which the prime mover 104 is an ICE, the rotation direction of the rotary driving force to be transmitted to the drive shaft 106 is switched between forward rotation and reverse rotation by a drive direction switching mechanism, without changing the rotation direction of the prime mover 104. In the present embodiment, a momentary switch is used for the switch 123. With this arrangement, the forward specification is given while the switch 123 is not being pressed and the reverse specification is given while the switch 123 is being pressed. Note that the embodiment is not limited to the above and may also be an alternate switch.

Figure 2:
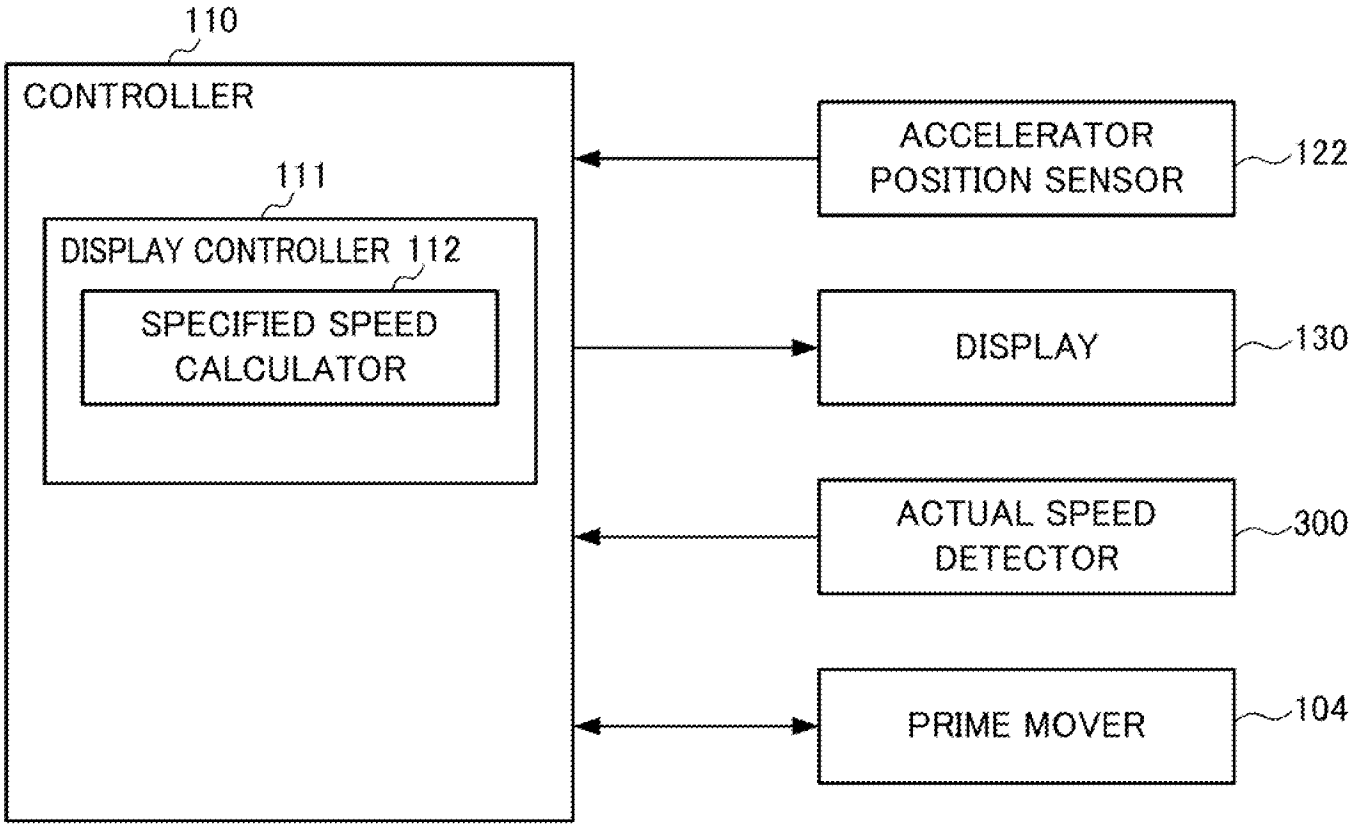
FIG. 2 is a block diagram for explaining a configuration of the display device for a watercraft in a first embodiment.

FIG. 2 is a block diagram for explaining a configuration of the display device for a watercraft in the first embodiment. The controller 110 includes a CPU, ROM, and RAM, for example. The controller 110 enacts various controls by loading a program stored in a storage medium such as the ROM into the RAM and executing the loaded program on the CPU.

The controller 110 acquires the amount of rotation inputted to the accelerator grip 121 (that is, the accelerator position) from the accelerator position sensor 122 and controls the rotation speed of the prime mover 104 in accordance with the amount of rotation input. The controller 110 also acquires, from the prime mover 104, the actual rotation speed of the prime mover 104 through a tachometer (not shown). An actual speed detector 300 reads location information from a Global Positioning System (GPS) unit (not shown), for example, to detect the actual speed of movement of the hull 200, and conveys the actual speed of movement of the hull 200 to the controller 110. Note that the actual speed detector 300 may use, not limited to GPS, but also another satellite positioning system. The actual speed detector 300 may be provided to the outboard motor 100, but multiple GPS antennas may be spaced apart from each other at multiple positions on the hull 200 to increase the positioning accuracy.

The controller 110 is provided with a display controller 111. The display controller 111 controls what is displayed on the display 130. The display controller 111 and the display 130 form the display device for a watercraft according to the present disclosure. Note that although the present embodiment illustrates an example in which the display controller 111 is configured as part of the controller 110, the display controller 111 may also be provided as a separate configuration from the controller 110. The display controller 111 is provided with a specified speed calculator 112. The specified speed calculator 112 calculates a specified speed on the basis of the accelerator position (amount of input) of the accelerator grip 121 obtained from the accelerator position sensor 122. The specified speed refers to the vessel speed calculated from the accelerator position of the accelerator grip 121 rather than the speed at which the hull 200 is actually moving, and is the speed that may be reached once the speed has risen sufficiently rather than the speed while the vessel is accelerating or decelerating. Therefore, the specified speed is the vessel speed thought to be desired by the pilot according to the operation of rotating the accelerator grip 121. Note that in the case of a watercraft having a shift lever rather than an accelerator grip, the lever position of the shift lever may be used.

Figure 3:
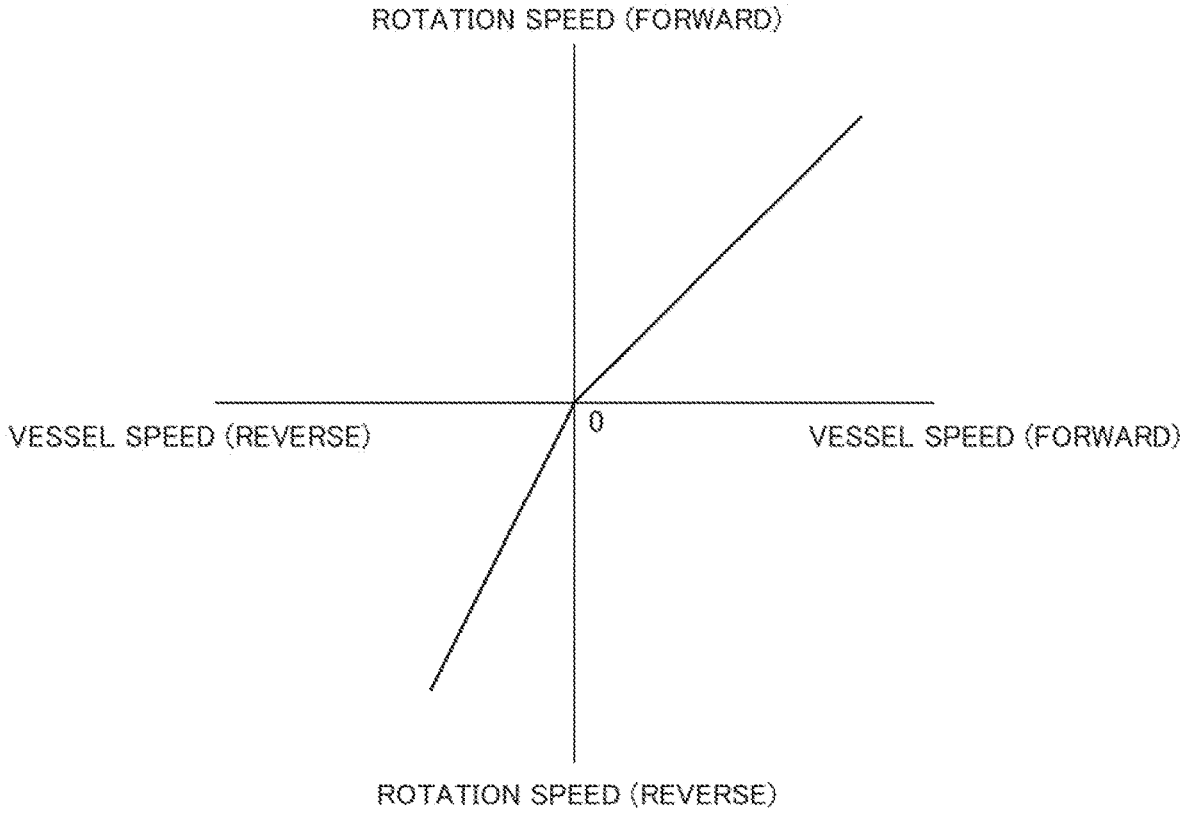
FIG. 3 is a diagram illustrating an example of the relationship between the rotation speed of a prime mover 104 and a vessel speed.

FIG. 3 is a diagram illustrating an example of the relationship between the rotation speed of a prime mover 104 and a vessel speed. The relationship between the rotation speed of the prime mover 104 and the vessel speed illustrated in FIG. 3 indicates the relationship in ideal conditions (hereinafter referred to as the ideal state) with no wind and no water currents. In addition, the relationship between the rotation speed of the prime mover 104 and the vessel speed illustrated in FIG. 3 indicates the relationship between the rotation speed of the prime mover 104 and the vessel speed in a state in which the rotation speed of the prime mover 104 and the vessel speed are constant, rather than an accelerating or decelerating state. Note that the slope of the line on the forward side and the reverse side is different because, due to the shape characteristics of the screw propeller 105, the thrust efficiency is high (speed is easily attained) for moving forward compared to moving in reverse. The relationship between the rotation speed of the prime mover 104 and the vessel speed can be expressed as a function of the rotation speed of the prime mover 104 and the vessel speed as in FIG. 3, for example. Note that although the rotation speed of the prime mover 104 is used in this case, the same applies to the case of using the rotation speed of the drive shaft 106 or the propeller shaft 108.

The specified speed calculator 112 stores a function expressing the relationship between the rotation speed of the prime mover 104 and the vessel speed as illustrated in FIG. 3, for example, and calculates a specified speed based on the accelerator position (amount of input) of the accelerator grip 121. In the present embodiment, the specified speed calculator 112 calculates the specified speed in the ideal state. Note that although the function expressing the relationship between the rotation speed of the prime mover 104 and the vessel speed as illustrated in FIG. 3 is assumed to be stored in advance, for example, the specified speed calculator 112 may also be configured to accumulate running data and execute machine learning to update the relationship between the rotation speed of the prime mover 104 and the vessel speed. Additionally, the specified speed calculator 112 may also accept the input of data pertaining to a hull model (the length and size of the hull) and load capacity depending on the cargo, number of occupants, and the like, and calculate a specified speed that takes this data into account.

Figure 4:
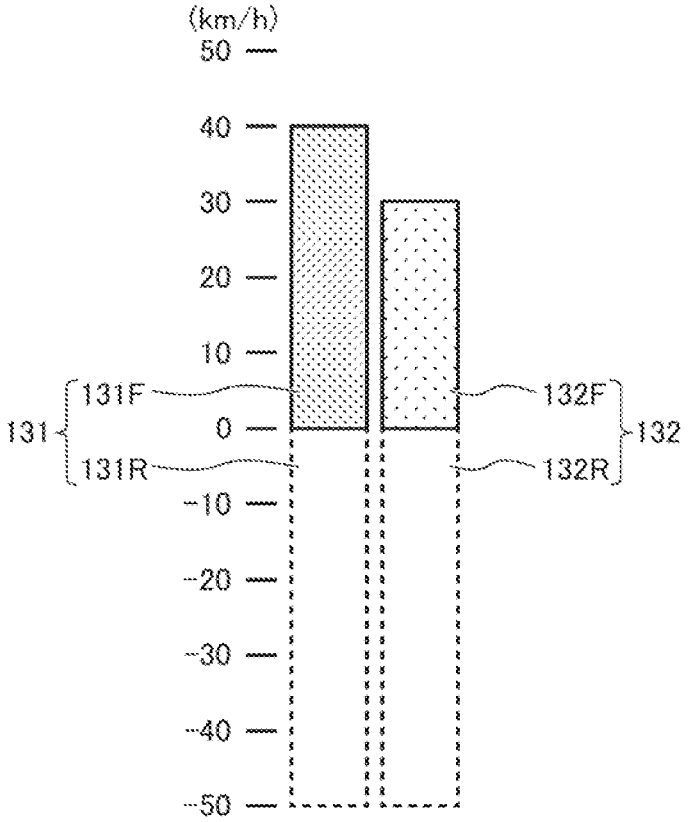
FIG. 4 is a diagram illustrating a display example on a display 130 according to the first embodiment.

The display controller 111 causes two indicators, namely a first indicator 131 indicating the specified speed in the ideal state based on an operation by the user, which is calculated by the specified speed calculator 112 described above, and a second indicator 132 indicating the actual speed of the vessel, to be displayed in juxtaposition on the display 130. FIG. 4 is a diagram illustrating a display example on the display 130 according to the first embodiment. Note that only the first indicator 131 and the second indicator 132 are illustrated in FIG. 4, but other information may also be displayed nearby. In the example illustrated in FIG. 4, the first indicator 131 and the second indicator 132 are both formed into linear, vertically orientated rectangles with the first indicator 131 and the second indicator 132 arranged from left to right. In FIG. 4, the upward direction is the direction indicating the speed when moving forward, and the downward direction is the direction indicating the speed when moving in reverse. In correspondence with these forward and reverse directions, the first indicator 131 has a forward indicator 131F and a reverse indicator 131R. Similarly, the second indicator 132 has a forward indicator 132F and a reverse indicator 132R. Also, in the example in FIG. 4, a speed (km/h) scale is provided beside the first indicator 131, with negative speeds indicating movement in reverse (the sample applies to the other drawings hereinafter). Note that instead of a scale, the speed may also be indicated by a numerical value placed near each of the first indicator 131 and the second indicator 132 or superimposed onto the first indicator 131 and the second indicator 132.

Figure 5:
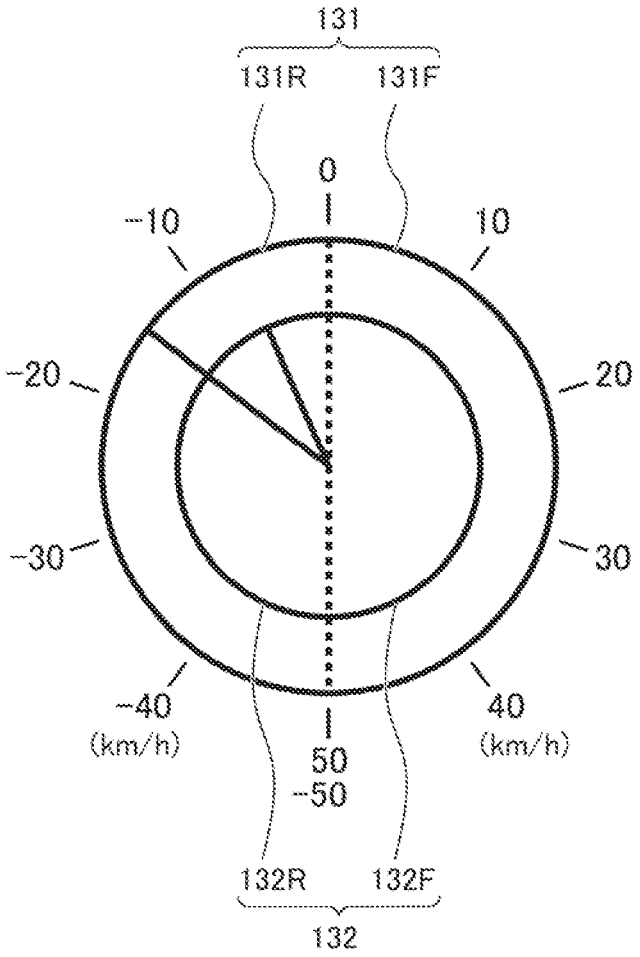
FIG. 5 is a diagram illustrating another display example on the display 130 according to the first embodiment.
Figure 6:
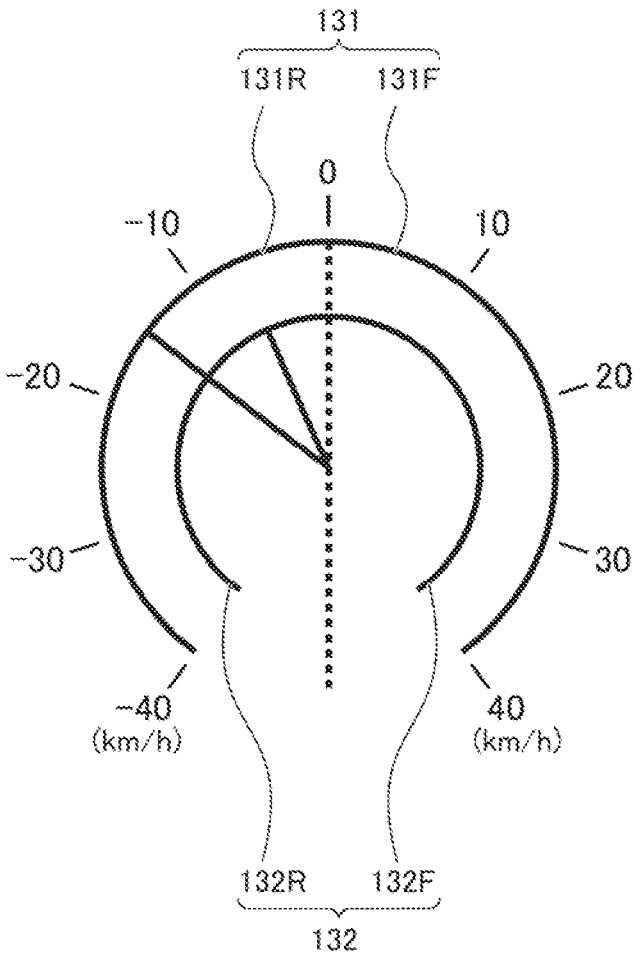
FIG. 6 is a diagram illustrating yet another display example on the display 130 according to the first embodiment.

FIG. 5 is a diagram illustrating another display example on the display 130 according to the first embodiment. In the example illustrated in FIG. 5, the first indicator 131 and the second indicator 132 are in a circular display form and are displayed substantially concentrically. FIG. 6 is a diagram illustrating yet another display example of the display 130 according to the first embodiment. In the example illustrated in FIG. 6, the first indicator 131 and the second indicator 132 are in a partially circular display form and are displayed substantially concentrically. In FIGS. 5 and 6, the right side of the drawing is the direction indicating the speed when moving forward, and the left side is the direction indicating the speed when moving in reverse. In correspondence with these forward and reverse positions, the first indicator 131 has a forward indicator 131F and a reverse indicator 131R. Similarly, the second indicator 132 has a forward indicator 132F and a reverse indicator 132R.

As described above, the display device for a watercraft according to the first embodiment causes the two indicators of the first indicator 131 indicating the specified speed based on an operation by the user and the second indicator 132 indicating the actual speed of the vessel to be displayed in juxtaposition on the display 130. Therefore, the disparity between the operating instruction and the actual vessel speed can be grasped easily. Moreover, since the forward indicators 131F, 132F and the reverse indicators 131R, 132R are included, agreement or disagreement between the direction of movement specified by the switch 123 and the actual direction of movement can be grasped easily.

Second Embodiment

A second embodiment and other embodiments described later are similar to the first embodiment except that the display form on the display 130 is different. Therefore, in the description of the second and subsequent embodiments, parts that fulfill functions similar to the first embodiment described above are denoted with the same signs, and a duplicate description of such parts is omitted where appropriate. Also, the second and subsequent embodiments only illustrate the example of displaying the first and second indicators with a linear shape, but in the second and subsequent embodiments, the first and second indicators may also be displayed with a circular or partially circular shape, similarly to the first embodiment. Furthermore, in the second and subsequent embodiments, the forward indicators 131F, 132F and the reverse indicators 131R, 132R are included, but a detailed description is omitted.

Figure 7:
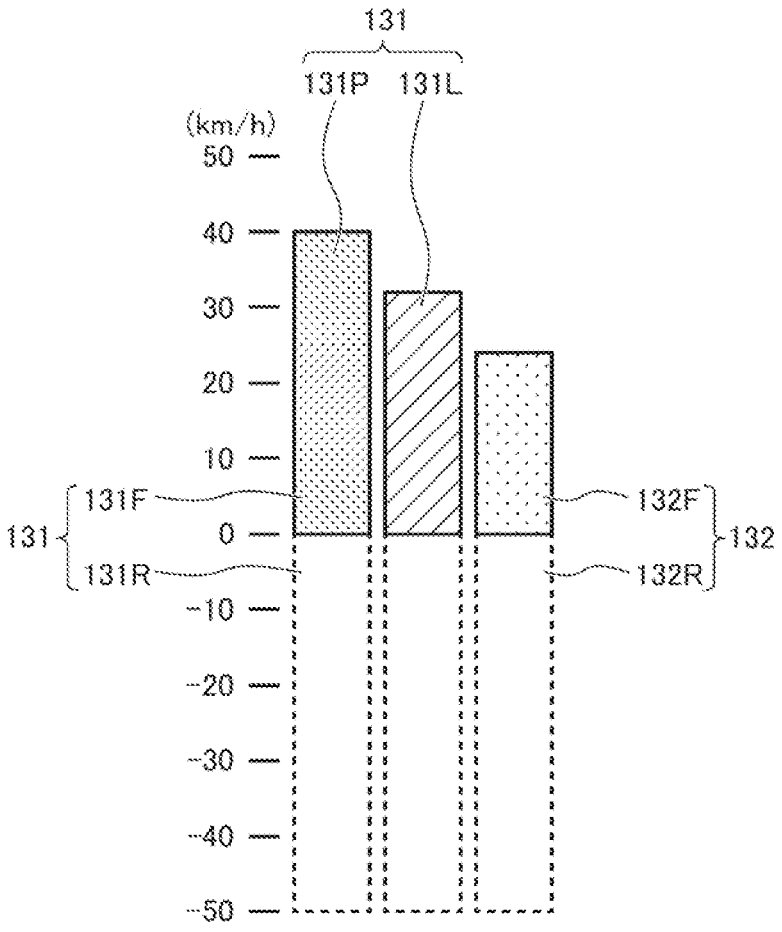
FIG. 7 is a diagram illustrating a display example on a display 130 according to a second embodiment.

FIG. 7 is a diagram illustrating a display example on the display 130 according to the second embodiment. In the second embodiment, a specified speed 131P in the ideal state, which is displayed as the first indicator 131 in the first embodiment, is displayed not alone but together with a specified speed 131L under load, which takes account of load factors. In the example illustrated in FIG. 7, the specified speed 131L under load is arranged beside the specified speed 131P in the ideal state. Examples of load factors that influence speed include wind, water currents such as tidal currents, and onboard load. The specified speed calculator 112 according to the second embodiment also calculates the specified speed taking account of load factors to be displayed as the specified speed 131L under load. The method of measuring the load factors may involve mounting an anemometer to the vessel in the case of wind, or a wave gauge in the case of waves.

Figure 8:
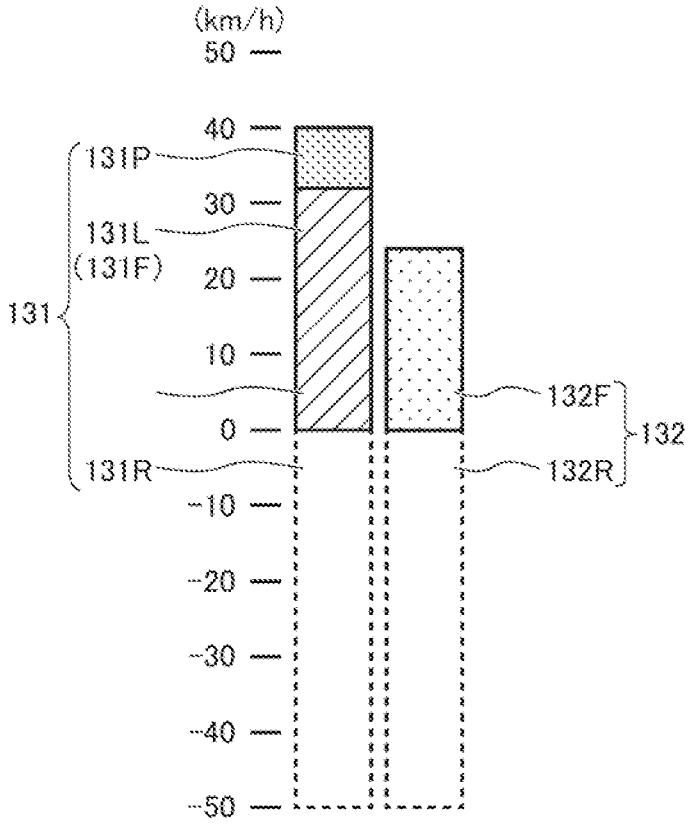
FIG. 8 is a diagram illustrating another display example on the display 130 according to the second embodiment.

FIG. 8 is a diagram illustrating another display example on the display 130 according to the second embodiment. In the example illustrated in FIG. 8, the specified speed 131L under load is superimposed over the specified speed 131P in the ideal state. Note that it is beneficial to vary the display color or the display density of the specified speed 131P in the ideal state and the specified speed 131L under load so that the specified speed 131P in the ideal state and the specified speed 131L under load can be distinguished visually. It is also possible to display only the specified speed 131L under load in juxtaposition with the second indicator 132 indicating the actual speed of the vessel, without displaying the specified speed 131P in the ideal state.

The behavior of a watercraft is greatly influenced by load conditions such as wind and water currents. For example, if there is a very strong headwind or a water current in the direction opposite to the direction of movement, it may not be possible to reach the vessel speed expected from the amount of input, and the vessel speed may be very slow in some cases, or the vessel may even be swept in the direction opposite to the desired direction of movement. In such cases, the pilot may feel discomfort. In the second embodiment, the specified speed 131L under load is displayed, thereby making it possible to display an appropriate specified speed closer to the actual state, and the disparity with the second indicator 132 indicating the actual speed of the vessel can be reduced. Therefore, the pilot can grasp the situation more appropriately and be less likely to feel discomfort, allowing the pilot to maneuver the vessel with assurance.

Third Embodiment

Figure 9:
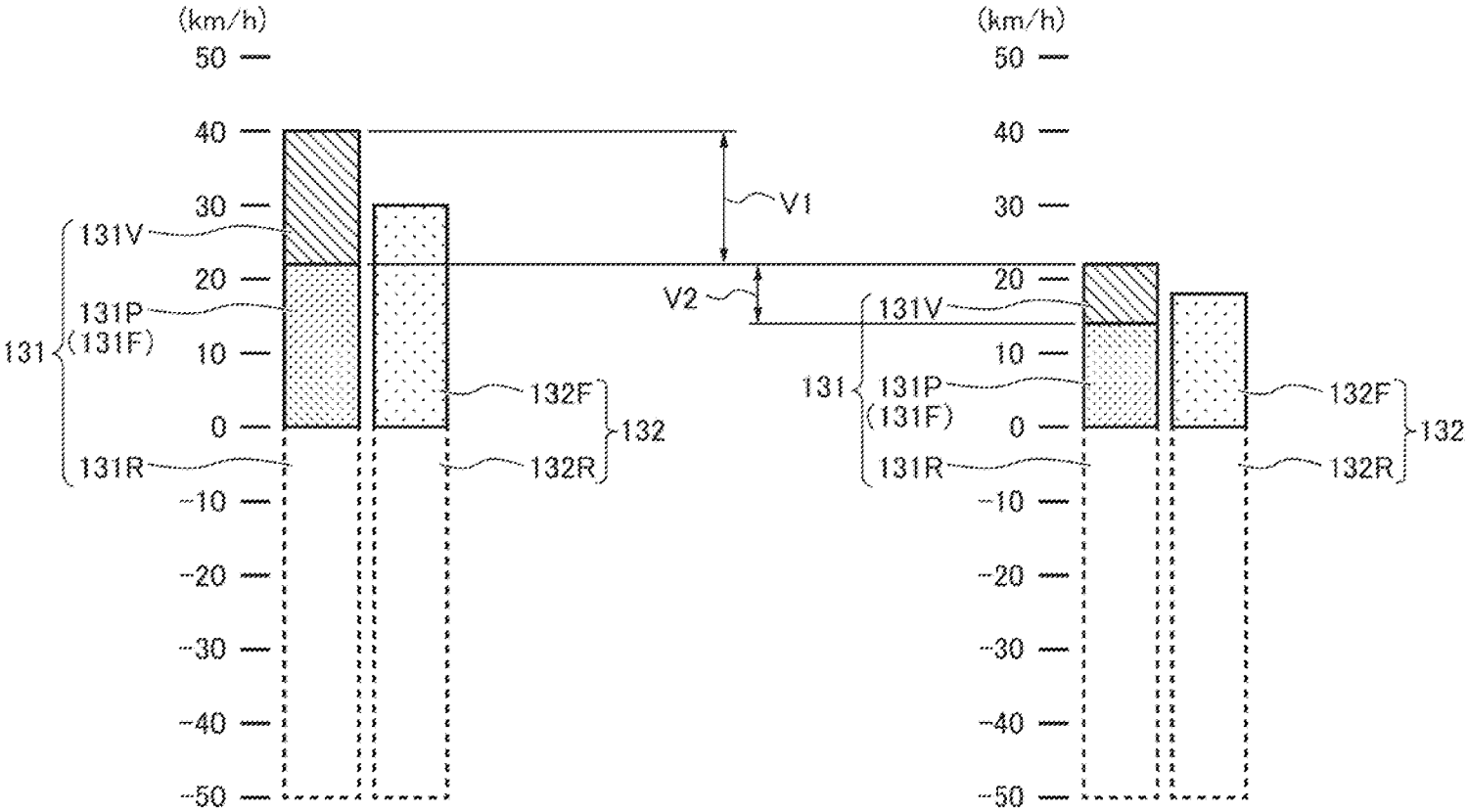
FIG. 9 is a diagram illustrating a side-by-side view of display examples for two different speeds on a display 130 according to a third embodiment.

FIG. 9 is a diagram illustrating a side-by-side view of display examples for two different speeds on a display 130 according to a third embodiment. In the third embodiment, a range of variation indicator 131V in which the specified speed varies depending on the load factors is superimposed onto the specified speed 131P in the ideal state described in the second embodiment. Note that, rather than superimposing the range of variation indicator 131V onto the specified speed 131P in the ideal state, the range of variation indicator 131V may simply be displayed together with the specified speed 131P in the ideal state; for example, the range of variation indicator 131V may be displayed beside the specified speed 131P in the ideal state. The range of variation indicator 131V is calculated by the specified speed calculator 112. The specified speed calculator 112 obtains the range of variation indicator 131V on the basis of wind, water currents such as tidal currents, and onboard load, for example. Among these load factors, since wind and water currents are not constant and vary from moment to moment, the specified speed calculator 112 accounts for the range of such variation to calculate the range of variation indicator 131V. The range of variation of the load factors may be predetermined, obtained by measuring data at the time, or acquired using a communication line.

Moreover, vessel speed is also largely influential as a load factor. That is, the faster the vessel speed is, the greater the influence of the load such as wind and water currents on the vessel speed is, and the wider the range of variation is. Accordingly, the range of variation indicator 131V displayed on the display 130, being calculated by accounting for the vessel speed, changes according to changes in the vessel speed. Normally, the faster the vessel speed is, the larger the range of variation indicator 131V is. The display example on the left side of FIG. 9 illustrates a display example for the case of a vessel speed of 40 km/h, while the display example on the right side illustrates a display example for the case of a vessel speed of 25 km/h. In the example in FIG. 9, a range of variation V1 of the range of variation indicator 131V for the case of a vessel speed of 40 km/h on the left side is wider than a range of variation V2 of the range of variation indicator 131V for the case of a vessel speed of 25 km/h on the right side. In this way, in the present embodiment, the range of variation indicator 131V also changes depending on the vessel speed.

According to the third embodiment, the range of variation indicator 131V is displayed together with the specified speed 131P in the ideal state, thereby making it easy to grasp the degree of the range over which the speed may vary from the specified speed 131P in the ideal state.

Fourth Embodiment

Figure 10:
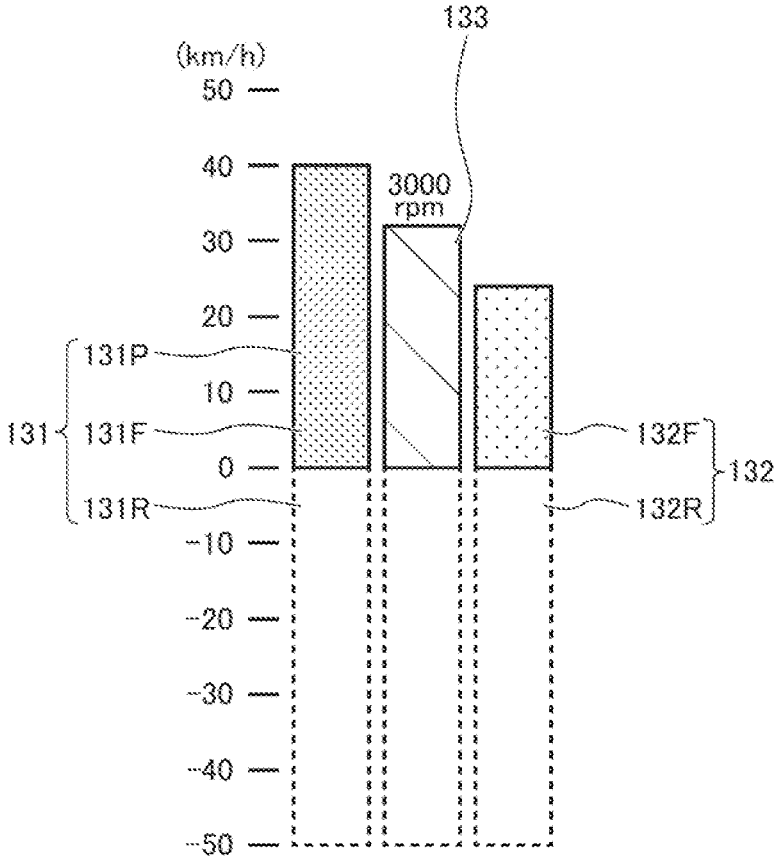
FIG. 10 is a diagram illustrating a display example on a display 130 according to a fourth embodiment.

FIG. 10 is a diagram illustrating a display example on the display 130 according to the fourth embodiment. In the fourth embodiment, a third indicator 133 that indicates the actual rotation speed of the prime mover 104 obtained from the prime mover 104 is displayed in juxtaposition with the specified speed 131P in the ideal state. In the example in FIG. 10, the third indicator 133 shows the rotation speed (in the example of FIG. 10, 3000 rpm) without providing a scale. Since the third indicator 133 shows the actual rotation speed of the prime mover 104, the pilot can become aware that, for example, the desired speed has not been reached due to load factors (disturbances) such as wind and water currents even though the rotation speed has risen appropriately. Also, whereas the specified speed shown by the first indicator is shown as a value obtained by calculation, the third indicator 133 shows the actual rotation speed of the prime mover 104, thereby making it easy to check that the prime mover 104 is actually being driven correctly and also allowing for easy comparison with the specified speed. Note that the third indicator 133 may also be configured to show the rotation speed of the screw propeller 105 rather than the rotation speed of the prime mover 104.

For example, if there is a very strong headwind or a water current in the direction opposite to the direction of movement, it may not be possible to reach the vessel speed expected from the amount of input, and in some cases, the vessel speed may be very slow even though the rotation speed of the prime mover is high. Even in such cases, according to the fourth embodiment, it is possible prevent the pilot from feeling discomfort or suspecting a malfunction of the watercraft.

Fifth Embodiment

Figure 11:
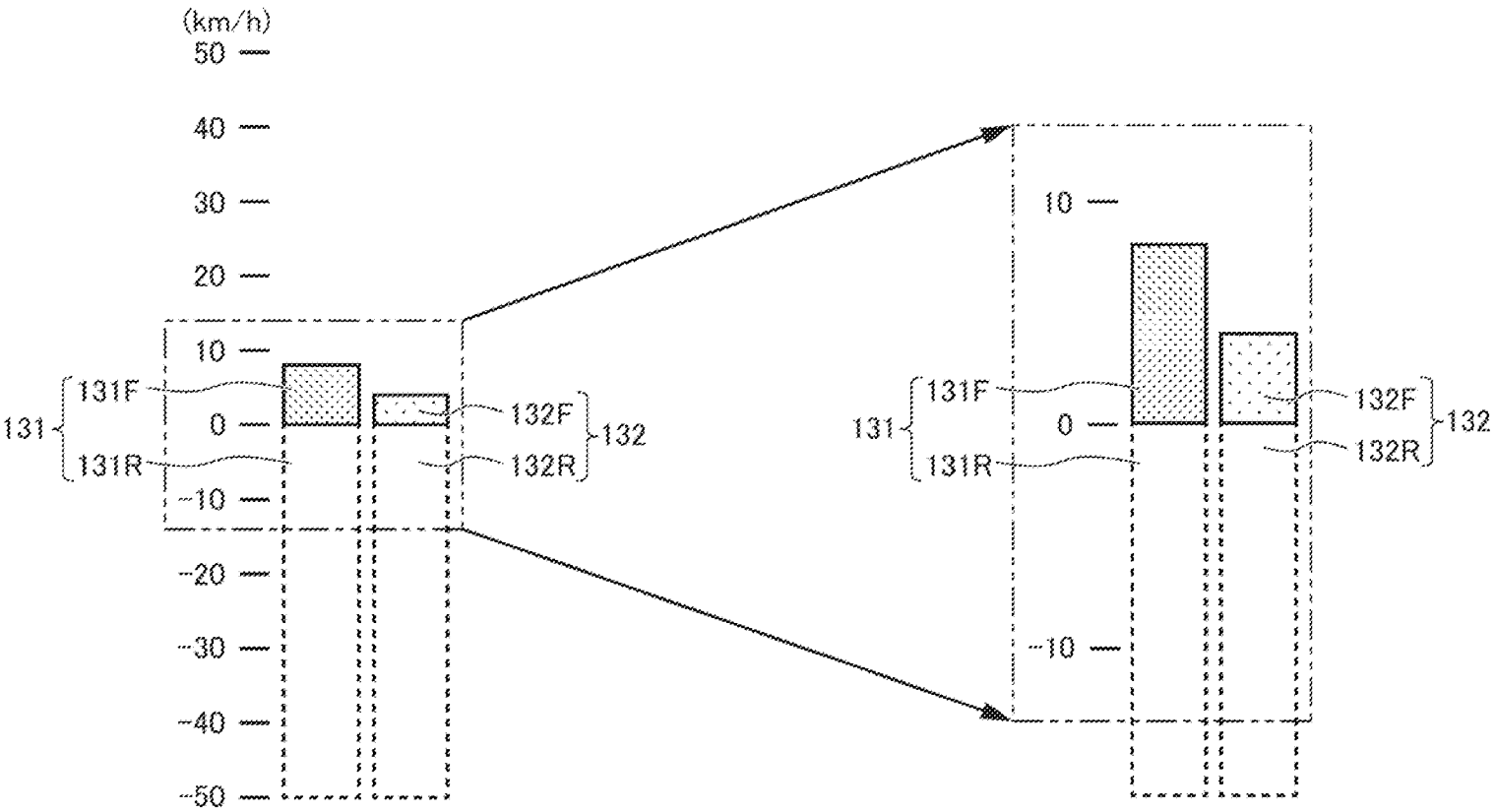
FIG. 11 is a diagram illustrating how a display example changes on a display according to a fifth embodiment.

FIG. 11 is a diagram illustrating how a display example changes on a display according to a fifth embodiment. In FIG. 11, the view on the left side illustrates a normal display form, while the view on the right side illustrates an enlarged display form. In the fifth embodiment, it is possible to show, on an enlarged scale, the vicinity of the boundary between the forward indicators 131F, 132F and the reverse indicators 131R, 132R, or in other words, the range where the speed is close to zero. As the speed is lowered and approaches zero, the display becomes smaller and therefore harder to see. Also, in the case of wanting to dock at a quay, careful maneuvering is required, and therefore the utility value of the first indicator 131 and the second indicator 132 rises. Accordingly, the present embodiment is configured to be able to display, on an enlarged scale, the vicinity of the boundary between the forward indicators 131F, 132F and the reverse indicators 131R, 132R. This configuration provides better visibility and usability at low speeds. Note that the enlarged view may be shown automatically when the speed comes within ±10 km, or may be shown in response to selection input by the pilot, for example. Moreover, the enlarged view may be shown at the position of the normal view or in a mode such that the normal view remains and the enlarged view is added nearby. According to the fifth embodiment, the view is enlarged in the low-speed range, thereby making it possible to grasp the situation in greater detail and precision.

(Modifications)

The present disclosure is not limited to the embodiments described above and may be subjected to various modifications and alterations which also fall within the scope of the present disclosure.

For example, the description of each of the embodiments gives an example in which the speed is shown as linear shapes in the vertical direction. However, the configuration is not limited to the above, and the speed may also be shown as linear shapes in the horizontal direction, for example.

Note that the embodiments and modifications may also combined as appropriate and used, but a detailed description is omitted. Furthermore, the present disclosure is not limited by the embodiments described above.

EXPLANATION OF REFERENCE NUMERALS

100: outboard motor
101: outboard motor body
102: mounting device
103: body case
104: prime mover
105: screw propeller
106: drive shaft
107: drive gear
108: propeller shaft
109: driven gear
110: controller
111: display controller
112: specified speed calculator
120: tiller handle
121: accelerator grip
122: accelerator position sensor
123: switch

130: display
131: first indicator
131F: forward indicator
131P: specified speed
131L: specified speed under load
131R: reverse indicator
131V: range of variation indicator
132: second indicator
132F: forward indicator
132R: reverse indicator
133: third indicator
200: hull
300: actual speed detector

What is claimed is:

1. A display device for a watercraft, the display device comprising:

a first indicator that shows a specified speed based on an operation by a user; and a second indicator that shows an actual speed of the watercraft, wherein the first indicator and the second indicator each include a forward indicator and a reverse indicator, and the first indicator and the second indicator are displayed in juxtaposition.

2. The display device for a watercraft according to claim 1, wherein the first indicator and the second indicator are each in a circular or partially circular display form and are displayed substantially concentrically.

3. The display device for a watercraft according to claim 1, wherein the first indicator and the second indicator are each in a linear display form and are displayed in juxtaposition.

4. The display device for a watercraft according to claim 1, wherein the first indicator shows only a specified speed that takes account of a load factor.

5. The display device for a watercraft according to claim 1, wherein the first indicator shows both of:

a specified speed in an ideal state not taking account of a load factor and a specified speed taking account of the load factor.

6. The display device for a watercraft according to claim 1, wherein the first indicator shows only a specified speed in an ideal state not taking account of a load factor.

7. The display device for a watercraft according to claim 1, wherein the first indicator shows a specified speed in an ideal state not taking account of a load factor, together with a display of a range of variation that varies depending on the load factor.

8. The display device for a watercraft according to claim 7, wherein the display of the range of variation changes depending on a speed of the watercraft.

9. The display device for a watercraft according to claim 1, further comprising:

a third indicator that shows a rotation speed of a prime mover or a screw propeller based on a throttle operation, wherein the first indicator and the third indicator are displayed in juxtaposition.

10. The display device for a watercraft according to claim 1, wherein at least one selected from the first indicator and the second indicator is capable of displaying, on an enlarged scale, a vicinity of a boundary between the forward indicator and the reverse indicator.

* * * * *